US010213932B2

(12) United States Patent
Brobeil et al.

(10) Patent No.: US 10,213,932 B2
(45) Date of Patent: Feb. 26, 2019

(54) HANDLE PROTECTOR FOR A HAND TOOL

(75) Inventors: Achim Brobeil, Dornstadt (DE); Patrick Missel, Westerstetten (DE); Wolfgang Arndt, Ulm (DE)

(73) Assignee: HUSQVARNA AB, Huskvarna (SE)

( * ) Notice: Subject to any disclaimer, the term of this patent is extended or adjusted under 35 U.S.C. 154(b) by 849 days.

(21) Appl. No.: 14/005,631

(22) PCT Filed: Mar. 24, 2011

(86) PCT No.: PCT/EP2011/054536
§ 371 (c)(1),
(2), (4) Date: Sep. 17, 2013

(87) PCT Pub. No.: WO2012/126527
PCT Pub. Date: Sep. 27, 2012

(65) Prior Publication Data
US 2014/0000116 A1 Jan. 2, 2014

(51) Int. Cl.

| | |
|---|---|
| ***B25G 1/10*** | (2006.01) |
| ***B25D 1/00*** | (2006.01) |
| ***B26B 23/00*** | (2006.01) |
| ***B25G 1/00*** | (2006.01) |
| ***B25G 3/34*** | (2006.01) |

(52) U.S. Cl.
CPC ..... *B26B 23/00* (2013.01); *B25D 1/00* (2013.01); *B25G 1/00* (2013.01); *B25G 1/10* (2013.01); *B25G 3/34* (2013.01)

(58) Field of Classification Search
CPC ... B25G 1/10; B25G 1/00; B25G 1/01; B25G 1/02; B25G 3/34; B25D 1/00; B25D 7/00; B26B 23/00
USPC ..... 30/308, 308.1
See application file for complete search history.

(56) References Cited

U.S. PATENT DOCUMENTS

| | | | | |
|---|---|---|---|---|
| 428,528 | A | * | 5/1890 | Schoettle |
| 489,511 | A | | 1/1893 | Terpening |
| 661,523 | A | | 11/1900 | Heintz |
| 822,006 | A | | 5/1906 | Lyons |
| 1,128,871 | A | | 2/1915 | Holik |
| 1,259,161 | A | | 3/1918 | Suer |

(Continued)

FOREIGN PATENT DOCUMENTS

| | | | |
|---|---|---|---|
| CA | 2059201 | A1 | 7/1993 |
| CA | 2585632 | A1 | 10/2007 |

(Continued)

OTHER PUBLICATIONS

Axe Dimensions Guide, printed from http://dimensionsguide.com/axe-dimensions/ on Sep. 24, 2010, all enclosed pages cited.

(Continued)

*Primary Examiner* — Phong Nguiyen
(74) *Attorney, Agent, or Firm* — Burr Forman McNair

(57) ABSTRACT

A hand tool (100, 200, 300) includes a working head (102), a handle (104) connected to the working head (102), and a handle protector (110, 302, 502) attached to the handle (104) proximate the working head (102). The handle protector (110, 302, 502) is manufactured from a metal sheet. Further, at least one portion of the handle protector (110, 302, 502) extends into the handle (104) to facilitate attachment of the handle protector (110, 302, 502) to the handle (104).

18 Claims, 7 Drawing Sheets

(56) References Cited

U.S. PATENT DOCUMENTS

| | | | | |
|---|---|---|---|---|
| 1,310,312 | A | 7/1919 | Tyson | |
| 1,342,495 | A * | 6/1920 | Brosch | B25D 7/00 16/109 |
| 1,633,319 | A | 6/1927 | Estwing | |
| 1,752,221 | A | 3/1930 | Anderson et al. | |
| 3,318,499 | A | 5/1967 | Kallio | |
| 3,877,826 | A | 4/1975 | Shepard, Jr. et al. | |
| 4,172,483 | A | 10/1979 | Bereskin | |
| D253,798 | S | 1/1980 | Altmiller | |
| 4,334,563 | A | 6/1982 | Epel et al. | |
| 4,773,286 | A | 9/1988 | Krauth | |
| 5,009,010 | A | 4/1991 | Burlison | |
| 5,141,353 | A | 8/1992 | Meredith et al. | |
| D354,212 | S | 1/1995 | Rönnhom et al. | |
| D396,790 | S | 8/1998 | Legacy | |
| 5,820,001 | A | 10/1998 | Soros | |
| D402,874 | S | 12/1998 | Hall et al. | |
| 5,896,788 | A | 4/1999 | Hreha et al. | |
| 6,202,511 | B1 | 3/2001 | Murray et al. | |
| 6,494,119 | B1 | 12/2002 | Coonrad | |
| D519,813 | S | 5/2006 | Hung | |
| D530,906 | S | 10/2006 | Polak et al. | |
| 7,181,994 | B2 | 2/2007 | Norton | |
| D607,295 | S | 1/2010 | Knight | |
| 2004/0154133 | A1 * | 8/2004 | Polzin | B25F 5/006 16/430 |
| 2007/0256278 | A1 | 11/2007 | Fortier et al. | |
| 2009/0126202 | A1 * | 5/2009 | Racamier | B26B 13/20 30/232 |
| 2010/0043165 | A1 * | 2/2010 | Juentgen | A46B 3/02 15/167.1 |

FOREIGN PATENT DOCUMENTS

| | | | |
|---|---|---|---|
| CN | 2344138 | Y | 10/1999 |
| CN | 1662346 | A | 8/2005 |
| CN | 2776634 | Y | 5/2006 |
| CN | 101396824 | A | 4/2009 |
| DE | 1695600 | U | 3/1955 |
| DE | 8325957 | U1 | 5/1984 |
| DE | 3719259 | A1 | 12/1988 |
| DE | 202004009647 | U1 | 10/2004 |
| EP | 0615819 | A1 | 9/1994 |
| EP | 1621295 | A1 | 2/2006 |
| GB | 2135625 | A | 9/1984 |
| RU | 37026 | U1 | 4/2004 |
| WO | 2009108977 | A1 | 9/2009 |

OTHER PUBLICATIONS

Buck Knives: Buck Camp Axe, BU-757BK, printed from http://www.knivesplus.com/BU-757BK-Buck.html on Sep. 24, 2010, all enclosed pages cited.

Gerber Extra Large Axe 28-1/2" Overall—Knifecenter.com; printed from http://knifecenter.com/kc_new/store_detail.htm?s=GB2730 on Sep. 24, 2010, all enclosed pages cited.

Camp Axes: Wetterlings and Gransfors Bruks Mini Hatchet, Wildlife Hatchet, printed from http://wisementrading.com/knifeandsaw/camp_axes.htm on Sep. 24, 2010, all enclosed pages cited.

Klein Tools Axe Guard, printed from http://www.mytoolstore.com/klein/5509.html on Sep. 24, 2010, all enclosed pages cited.

Fiskars Super Splitting Axe-28 inch, printed from http://www2.fiskars.com/products/yard-and-garden/axes-and-striking/super-splitting-A . . . on on Sep. 24, 2010, all enclosed pages cited.

Maul with Handle Guard, printed from http://tools.websgreatestfinds.com/maul-with-handle-guard on Sep. 24, 2010, all enclosed pages cited.

HandleSavers, printed from http://www.awesometools.com/handlesavers-handle-savers.asp on Sep. 24, 2010, all enclosed pages cited.

Laplander Sheath and heavy detachable danglies, printed from http://www.bushcraftuk.com/forum/showthread.php?p=419721 on Sep. 24, 2010, all enclosed pages cited.

International Search Report and Written Opinion of PCT/EP2011/054536 dated Mar. 27, 2012, all enclosed pages cited.

Chapter I International Preliminary Report on Patentability of PCT/EP2011/054536 dated Sep. 24, 2013, all enclosed pages cited.

* cited by examiner

HANDLE PROTECTOR FOR A HAND TOOL

TECHNICAL FIELD

The present invention relates to a handle protector. More particularly, it relates to a handle protector that protects a handle of a hand tool.

BACKGROUND

Hand tools, such as, axes, hammers, or the like are well known in the art. A hand tool typically includes a working head attached to a handle. During an operation of the hand tool, a portion of the handle near the working head may accidentally strike an external object. Since the handle is usually made of a lighter and lower impact resistant material as compared to that of the working head, such accidental impacts may lead to damage of the handle. Further, vibrations from the impact may propagate to the hands of the user gripping the handle, and cause inconvenience.

Solutions to the above problems include providing the working head with an integral handle protector that extends down and shields the portion of the handle vulnerable to accidental impacts. However, the working head is usually made of a costly material and requires various complicated manufacturing processes, such as, casting, forging etc. Thus, integrally manufacturing a handle protector with the working head may be complicated and costly. Alternatively, the handle protector may be manufactured separately and mechanically fastened to the handle and/or the working head via rivets, interference fits, or the like. However, mechanical attachments may not be able to withstand repeated impacts and may fail during usage.

Therefore there is a need for a handle protector that overcomes the aforementioned problems.

SUMMARY

In view of the above, it is an objective to solve or at least reduce the problems discussed above. In particular, an objective is to provide a handle protector that is inexpensive, involves simple manufacturing processes and is reliably secured to a hand tool. The objective is achieved with a hand tool according to an example embodiment. The hand tool includes a working head, a handle connected to the working head, and a handle protector attached to the handle proximate the working head. Further, the handle protector is manufactured from a metal sheet and at least one portion of the handle protector extends into the handle to facilitate attachment of the handle protector to the handle. Since the handle protector is made in a single piece out of a metal sheet, handle protector may be manufactured by various simple processes. The material of the handle protector may be of a lower cost and strength than that of working head.

According to an example embodiment, the handle protector is attached to the handle using injection moulding. According to an example embodiment, a moulding material is injected between the handle protector and the handle to attach the handle protector to the handle. Alternatively, according to an example embodiment, the handle is made of a moulding material and the handle is moulded over the handle protector using injection moulding. Further, according to an example embodiment, the handle is further moulded over the working head using injection moulding. According to an example embodiment, the moulding material is a polymer.

According to an example embodiment, the handle protector includes a front member and two side members. Further, the front member and the side members form a substantially U-shape. The U-shape may be adapted to conform to the shape of the handle and facilitate attachment to the handle.

According to an example embodiment, each side member at least partially extends into the handle. Further, according to an example embodiment, each side member includes at least one lateral projection, the at least one lateral projection extending into the handle. Moreover, according to an example embodiment, the at least one lateral projection includes at least one aperture. The at least one aperture may facilitate flow of the moulding material during attachment of the handle protector to the handle.

According to an example embodiment, wherein each side member includes at least one protrusion extending into the handle. Further, according to an example embodiment, each protrusion extends into a corresponding groove on the handle. This may enable the side members of the handle protector to snugly fit into the handle and prevent the side members from being deformed away from the handle. Alternatively, according to an example embodiment, each protrusion includes one or more locking portions engaging with a corresponding projection on the handle to attach the handle protector to the handle. The one or more locking projections may form a snap-fit with the corresponding projection on the handle.

According to an example embodiment, the handle protector is further attached to the handle by an adhesive joint.

According to an example embodiment, the handle protector includes at least one indentation adapted to improve protection of the handle. The indentations may improve absorption of impact energy and/or provide increased strength of the handle protector.

According to an example embodiment, the hand tool is an axe or a hammer.

BRIEF DESCRIPTION OF THE DRAWINGS

The invention will in the following be described in more detail with reference to the enclosed drawings, wherein.

DESCRIPTION OF EMBODIMENTS

Figure 1:
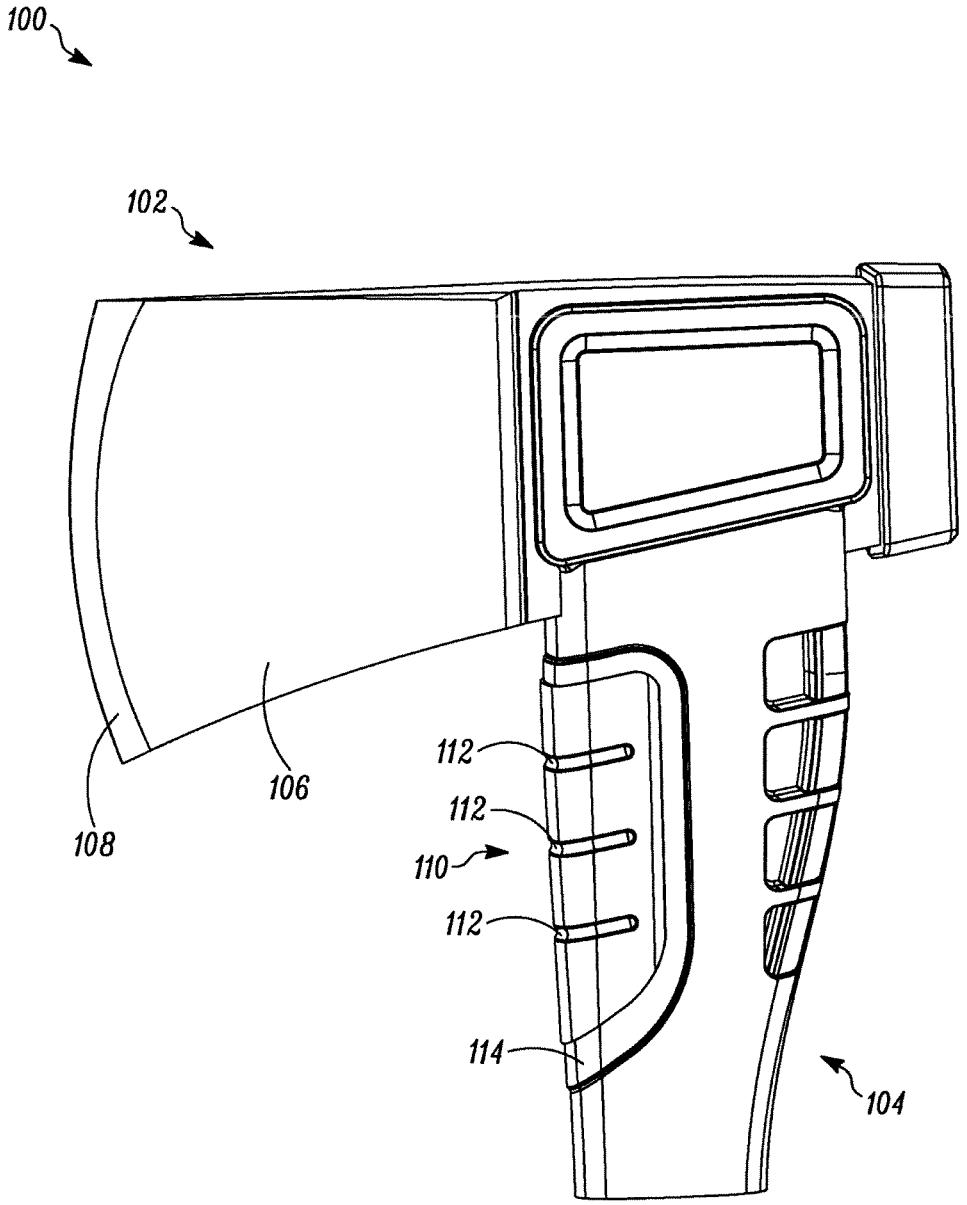
FIG. 1 illustrates a partial view of a hand tool having a handle protector, according to an embodiment of the present invention.

The present invention will be described more fully hereinafter with reference to the accompanying drawings, in which preferred embodiments of the invention are shown. This invention may, however, be embodied in many different forms herein; rather, these embodiments are provided so that this disclosure will be thorough and complete, and will fully convey the scope of the invention to those skilled in the art. In the drawings, like numbers refer to like references.

FIG. 1 illustrates a partial view of a hand tool 100, according to an embodiment of the present invention. Though the hand tool 100 illustrated in FIG. 1 is an axe, the present invention may be applicable to any type of hand tool 100, for example, but not limited to, a hammer, a splitting maul, an adze, or the like. Moreover, the shape and size of the hand tool 100 is purely exemplary in nature, and the hand tool 100 may be of other configuration within the scope of the present invention.

As illustrated in FIG. 1, the hand tool 100 includes a working head 102 attached to a handle 104. Further, the working head 102 includes a blade 106 with a cutting edge 108. The working head 102 may be made of any material, for example, a metal, a metallic alloy, a composite, or the like. Further, the working head 102 may be manufactured by one or more processes, such as, casting, forging, machining etc. The working head 100 may be manufactured as a single piece. Alternatively, various components of the working head 100 may be manufactured separately and then bonded to one another. In various embodiments of the present invention, the working head 102 may also include other working portions, for example, a hammer portion, a piercing portion, a digging portion etc. The handle 104 is only partially shown in FIG. 1 and is adapted to be gripped by a user during operation of the hand tool 100. The handle 104 may of any variable cross-section within the scope of the present invention. Further, a shape of the handle 104 may change along its length. For example, the handle 104 may include a curved portion not shown) near a lower end for better ergonomics. The handle 104 may also include ribs or grooves for better gripping.

As illustrated in FIG. 1, a handle protector 110 is provided proximate the working head 102. The handle protector 110 is adapted to safeguard the handle 104 when the handle 104 accidentally strikes against an external object. In the absence of the handle protector 110, the handle 104 may sustain damage due to impact against a hard external object since the handle 104 is usually made of a lighter and lower impact resistant material as compared to that of the cutting head 102. Moreover, the handle protector 110 may also reduce propagation of vibrations, from an impact, to the hands of the user. Further, the handle protector 110 includes multiple indentations 112 for improved absorption of impact energy and/or increased strength of the handle protector 110.

In an embodiment of the present invention, the handle protector 110 is made in a single piece out of a metal sheet. The metal may be aluminium, steel, or the like. The metal sheet may be given the final shape of the handle protector 110 by various simple manufacturing processes, such as, punching, stamping, or the like. Thus, the handle protector 110 may not require any complicated and costly manufacturing processes, for example, casting, forging etc. Moreover, the material of the handle protector 110 may be of a lower cost and strength than that of working head 102.

Further, the handle protector 110 is attached to the handle 104 by injection moulding adjacent a portion 114 of the handle 104. The portion 114 may form an attachment interface between the rest of the handle 104 and the handle protector 110. In an embodiment of the present invention, the handle protector 110 may include at least one portion (described with reference to FIGS. 2A-2D) that extend into the handle 104 to improve the attachment of the handle protector 110 to the handle 104 using injection moulding. Further, the handle protector 110 has a substantially U-shape (illustrated in FIGS. 2A and 2B) so that the handle protector 110 may be easily attached to the handle 104. In an embodiment of the present invention, the working head 102 and the handle protector 110 may be first manufactured and then placed in a mould. Subsequently, a moulding material may be injected into the mould, forming the handle 104 which is attached to the working head 102 and the handle protector 110. Thus, the handle 104 is moulded over the working head 102 and the handle protector 110 by injection moulding. In such case, the handle 104 may be made of a moulding material, such as, a thermoplastic, a thermosetting plastic, or any other polymer. In another embodiment of the present invention, the handle 104 may be manufactured separately and attached to the working head 102 and the handle protector 110 by injecting a moulding material between the handle 104 and the working head 102, and the handle 104 and the handle protector 110 respectively. In an alternative embodiment of the present invention, the handle 104 may be first mechanically attached to the working head 102, for example, via one or more wedges, fasteners etc. In such cases, the handle 104 may be made of wood or reinforced plastic. Subsequently, the handle protector 110 is attached to the handle 104 by injecting a moulding material at the interface between the handle 104 and the handle protector 110. FIGS. 2A-2D illustrates different views of the handle protector 110, according to an embodiment of the present invention. The handle protector 110 includes a front member 202 and two substantially identical side members 204 located at two sides of the front member 206. The front member 202 together with the side members 204 form a substantially U-shape 206 adapted to conform to the shape of the handle 104 and facilitate attachment to the handle 104. Further, edges between an upper end 208 and a lower end 210 of the front member 206, and the side members 204 are chamfered. This may reduce stress concentrations at the edges and improve impact resistance of the handle protector 110. In an embodiment of the present invention, a maximum width 212 of the handle protector 110 lies substantially within a range from about 20 mm to 50 mm. Further, a maximum height 214 of the handle protector 110 lies substantially within a range from about 50 mm to 120 mm. Moreover, a maximum depth 216 of the handle protector 110 lies substantially within a range from about 15 mm to 50 mm. Additionally, the indentations 112 on a front surface 218 of the handle protector 110 form corresponding raised portions 220 on a rear surface 222 of the handle protector 110. The rear surface 222 faces the handle 110 and is attached to the handle 110, while the front surface 218 receives accidental impacts during usage.

Figure 2A:
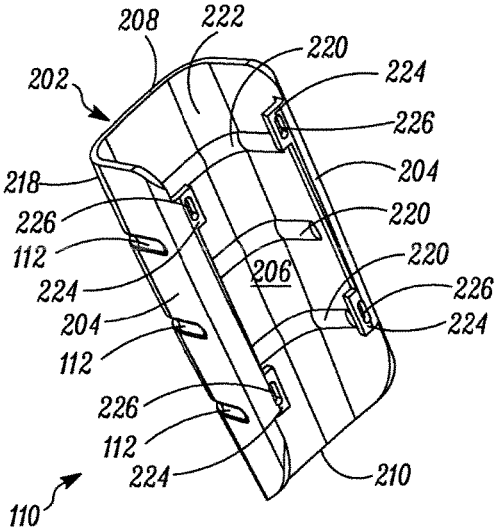
FIG. 2A illustrates a perspective view of the handle protector, according to an embodiment of the present invention.
Figure 2B:
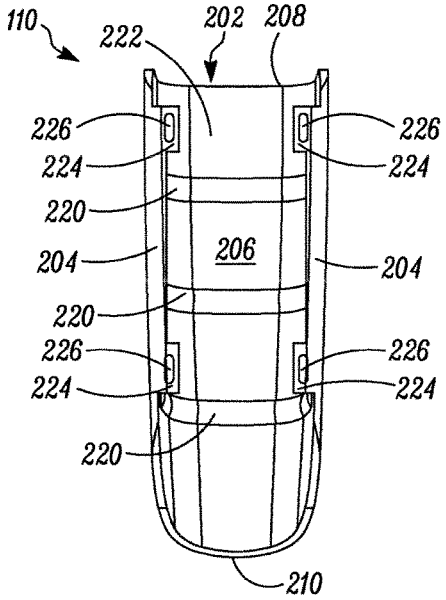
FIG. 2B illustrates a rear view of the handle protector, according to the embodiment of FIG. 2A.
Figure 2C:
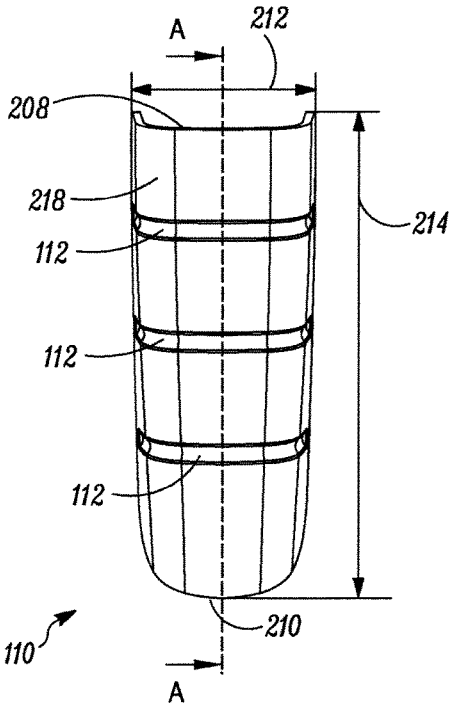
FIG. 2C illustrates a front view of the handle protector, according to the embodiment of FIG. 2A.
Figure 2D:
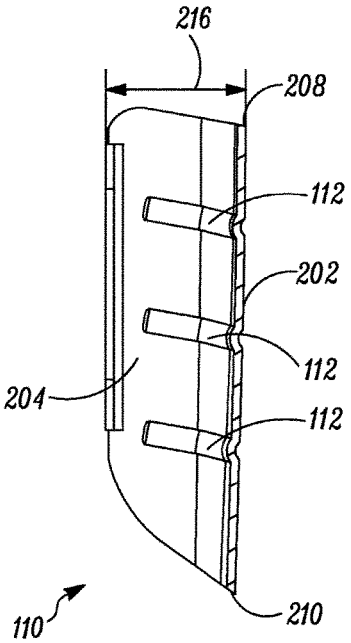
FIG. 2D illustrates is a sectional view of the handle protector along an axis A-A, according to the embodiment of FIG. 2A.

As illustrated in FIGS. 2A and 2B, lateral projections 224 from each of the side members 204 include apertures 226. The lateral projections 224 along with the apertures 226 extend into the handle 104. The apertures 226 facilitate flow of the moulding material to the interior of the U-shape 206 during attachment of the handle protector 110 to the handle 104. This may improve attachment of the handle protector 110 to the handle 104.

It may be apparent to a person ordinarily skilled in the art that the details of the handle protector 110, as described with reference to FIGS. 2A-2D, are purely exemplary in nature, and the handle protector 110 may be any other shape, configuration or dimensions within the scope of the present invention. For example, the handle protector 110 may the number of the indentations 112 may be four instead of three as shown. Moreover, the number of apertures 226 may be circular, elliptical, polygonal or any other shape instead of the oblong shape as shown.

Figure 3B:
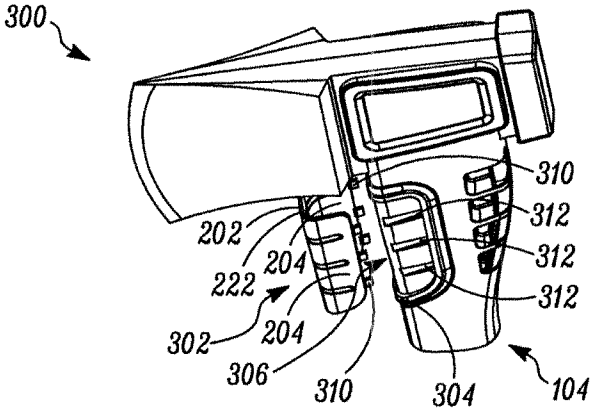
FIG. 3B illustrates another partial perspective view of the handle protector and the handle protector, according to the embodiment of FIG. 3A.
Figure 3C:
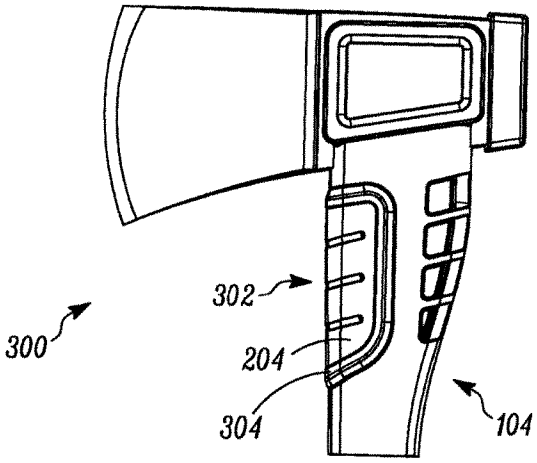
FIG. 3C illustrates a partial front view of the hand tool and handle protector in an assembled state, according to the embodiment of FIG. 3A.
Figure 3A:
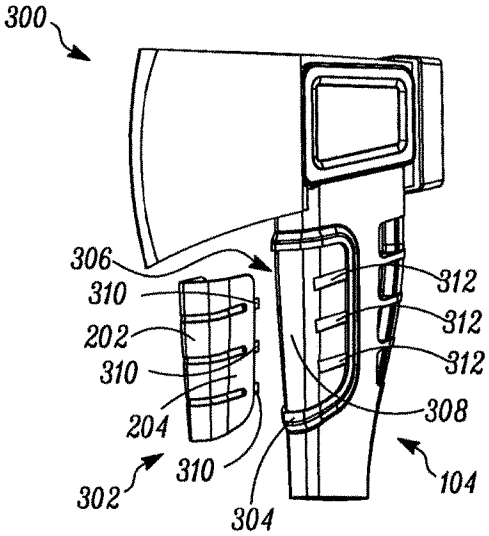
FIG. 3A illustrates a partial perspective view of the hand tool and the handle protector having at least one protrusion, according to an embodiment of the present invention.
Figure 4A:
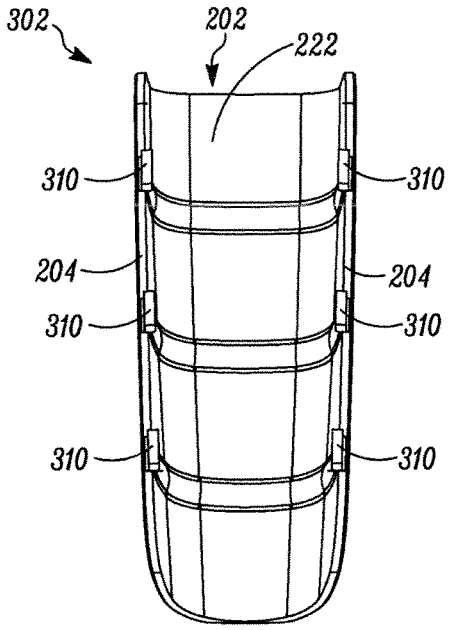
FIG. 4A illustrates a rear view of the handle protector having at least one protrusion, according to an embodiment the present invention.
Figure 4B:
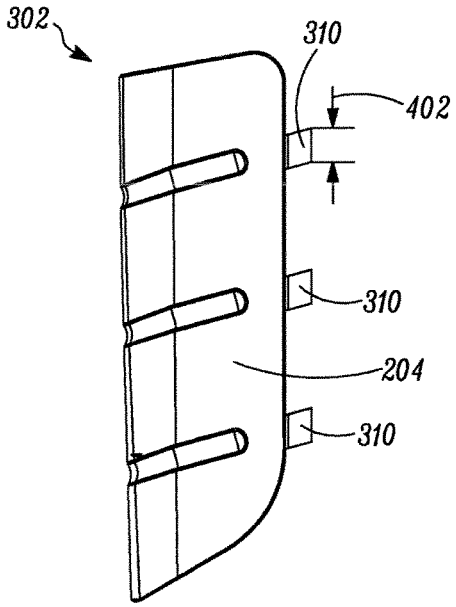
FIG. 4B illustrates a side view of the handle protector, according to the embodiment of FIG. 4A.
Figure 4C:
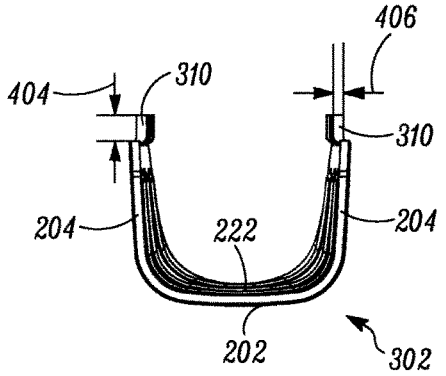
FIG. 4C illustrates a top view of the handle protector, according to the embodiment of FIG. 4A.

FIGS. 3A-3C illustrate a hand tool 300 with a handle protector 302, according to another embodiment of the present invention. A raised portion 304 of the handle 104 surrounds a recessed area 306 which has a shape substantially corresponding to that if the handle protector 302. The recessed area 306 includes a joining surface 308 where an adhesive is applied to attach the handle protector 302 with the handle 104 via an adhesive joint. The joining surface 308 on the handle 104 may be attached to a portion of the front member 202 of the handle protector 302 at the inner surface 222. Further, each side member 204 of the handle protector 302 includes three protrusions 310 which extend into corresponding grooves 312 provided on the recessed area 306. This may enable the side members 204 of the handle protector 300 to snugly fit into the recessed area 306 and prevent the side members 204 from being deformed away from the recessed area 306. In an assembled condition, as illustrated in FIG. 3C, the protrusions 310 remain hidden with the recessed area 306 and may not interfere with an operation of the hand tool 300. FIGS. 4A-4C illustrate different views of the handle protector 302, according to another embodiment of the present invention. As illustrated in FIGS. 4A-4C, each side member 204 includes three protrusions 310. In an embodiment of the present invention, a depth 402 of each protrusion 310 lies within a range from about 3 mm to 10 mm. Further, a length 404 of each protrusion 310 lies within a range from about 3 mm to 10 mm. Moreover, a width 406 of each protrusion 310 lies within a range from about 0.5 mm to 2 mm. The rear surface 222 of the handle protector 302 corresponding to a portion of the front member 202 may be attached to the joining surface 308 of the recessed area 306 by the adhesive joint. It may be apparent to a person ordinarily skilled in the art that the protrusions 310 may be any other shape or dimensions within the scope of the present invention. Further, there may be any number of the protrusions 310 provided on each side member 204.

Figure 5C:
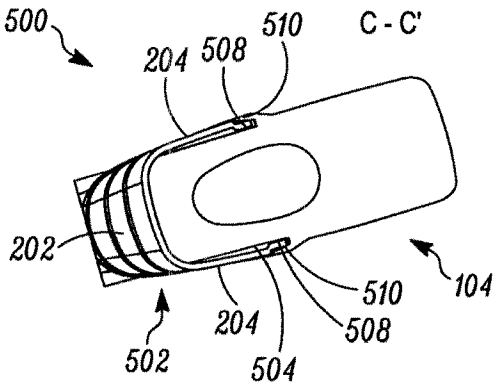
FIG. 5C illustrates a sectional view of the hand tool and handle protector along an axis C-C', according to the embodiment of FIG. 5A.
Figure 5B:
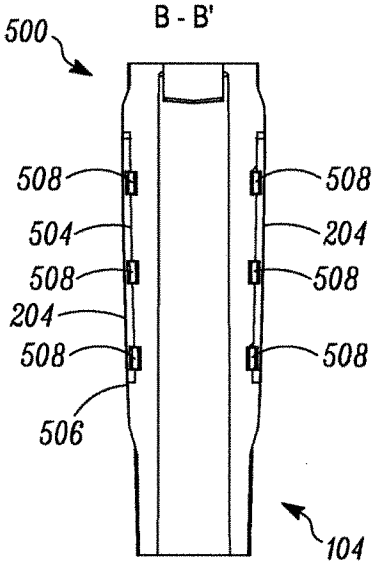
FIG. 5B illustrates a sectional view of the handle protector and the handle protector along an axis B-B', according to the embodiment of FIG. 5A.
Figure 5A:
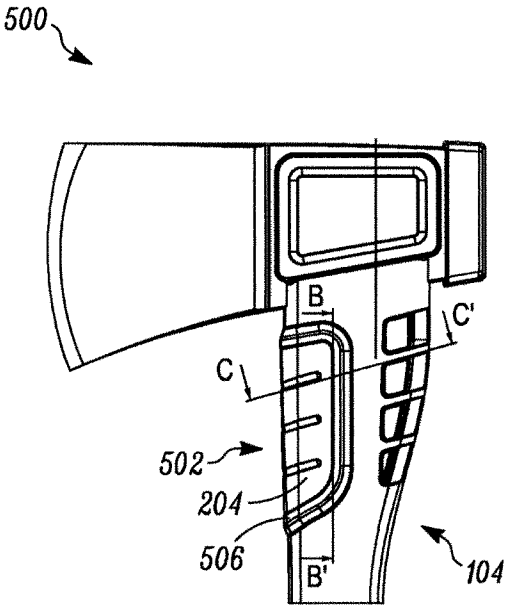
FIG. 5A illustrates a side view of the hand tool and the handle protector having at least one protrusion, according to another embodiment of the present invention.

FIGS. 5A-5C illustrate different views of a hand tool 500 with a handle protector 502, according to a further embodiment of the present invention. The handle protector 502 fits into a recessed area 504 which is surrounded by the raised portion 506 of the handle 104. Further, each side member 204 of the handle protector 502 includes three protrusions 508. Each protrusion 508 engages with a corresponding projection 510 also provided on the handle 104. An adhesive joint, preferably attached to joining section 308, is provided to fix the handle protector 502 to handle 500.

FIGS. 6A-6D illustrate different views of the handle protector 502, according to a further embodiment of the present invention. Each protrusion 508 includes two locking portions 602 located at an upper end and a lower end respectively. The locking portions 602 may be flexible such that the locking portions 602 form a snap-fit with the corresponding projection 510 on the handle 104. Thus, the handle protector 502 may be securely attached to the handle 104. In an embodiment of the present invention, an adhesive joint, preferably applied to joining section 308, may also be provided in addition to the snap-fit.

Figure 6A:
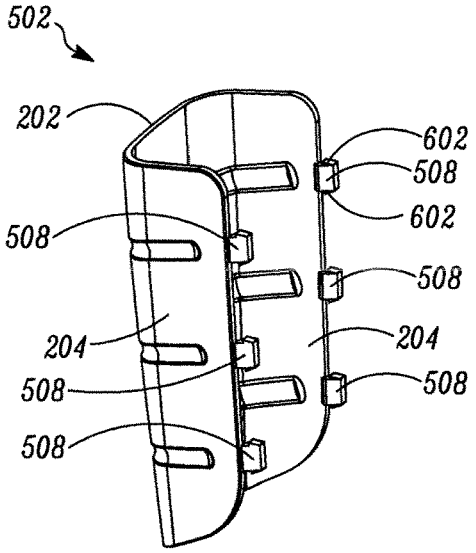
FIG. 6A illustrates a perspective view of the handle protector having at least one protrusion, according to another embodiment the present invention.
Figure 6B:
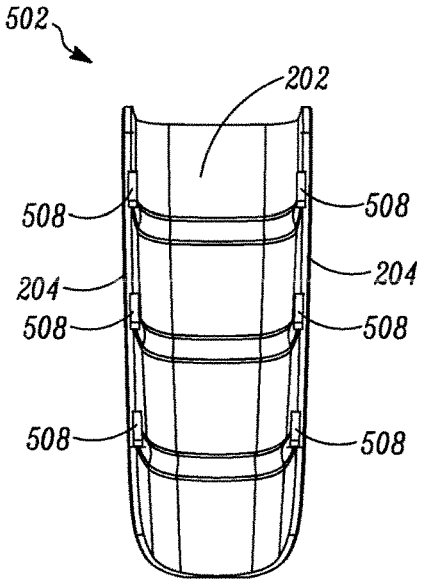
FIG. 6B illustrates a rear view of the handle protector, according to the embodiment of FIG. 6A.
Figure 6C:
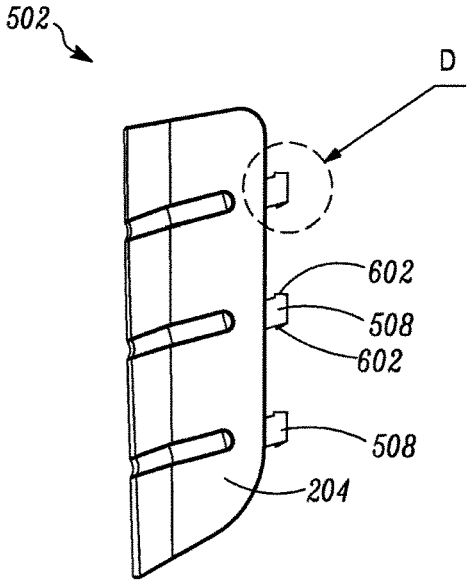
FIG. 6C illustrates a side view of the handle protector, according to the embodiment of FIG. 6A.
Figure 6D:
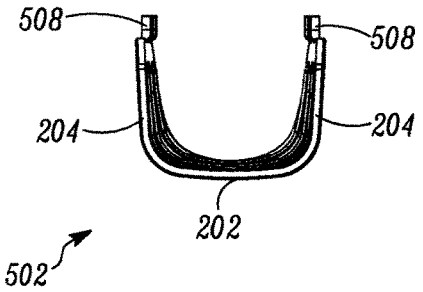
FIG. 6D illustrates a top view of the handle protector, according to the embodiment of FIG. 6A.
Figure 7:
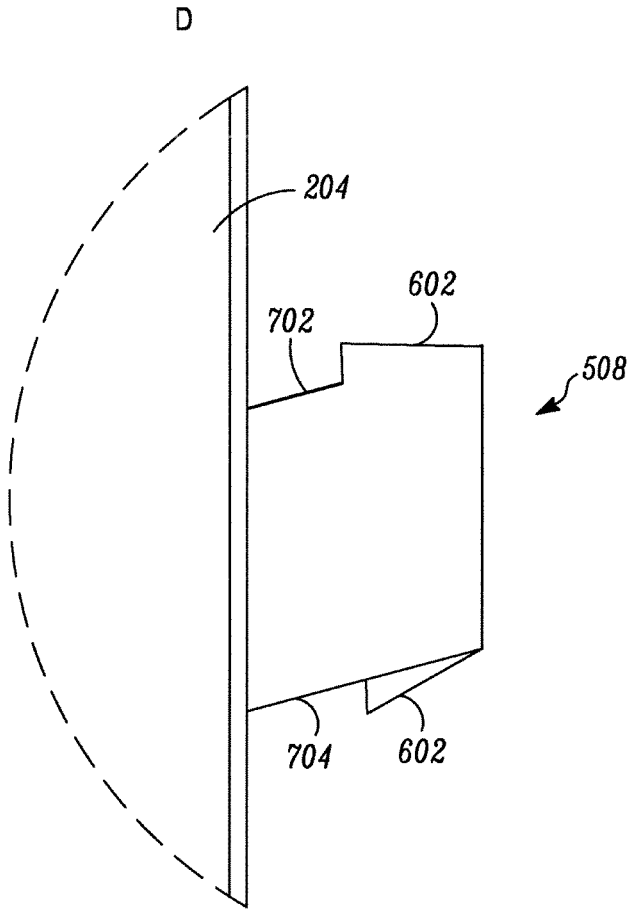
FIG. 7 illustrates a detailed view of a part D in FIG. 6C, according to an embodiment of the present invention.

FIG. 7 illustrated a detailed view of the protrusion 508, according to an embodiment of the present invention. As illustrated in FIG. 7, the locking portions 602 are provided at an upper end 702 and a lower end 704 of the protrusion 508. However, the locking portions 602 illustrated in FIGS. 6A-7 are for exemplary purposes only, and the locking portions 602 may be of any other shape or configuration within the scope of the present invention. Moreover, any other number of locking portions 602 may be provided on the protrusion 508.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A hand tool comprising:

a working head;

a handle connected to the working head, the handle configured for gripping by a user during operation of the tool; and a handle protector attached to the handle at or proximate a raised portion of the handle, the raised portion being proximate the working head, wherein the handle protector is manufactured from a metal sheet;

wherein the raised portion of the handle surrounds a recessed area of the handle, the recessed area having a shape substantially corresponding to a shape of the handle protector;

wherein the handle protector comprises a front member and two side members;

wherein each side member comprise at least one protrusion configured to extend into a corresponding first groove on the handle to facilitate attachment of the handle protector to the handle; and wherein the handle protector includes at least one indention on a front surface thereof and at least one corresponding raised portion on a rear surface thereof, the rear surface of the handle protector being attached to the recessed area of the handle;

wherein the at least one indention extends transversely along the handle protector relative to a longitudinal axis of the handle protector; and wherein the handle comprises a corresponding second groove to receive the corresponding raised portion of the handle protector.

2. A hand tool according to claim 1, wherein a moulding material is injected between the handle protector and the handle to attach the handle protector to the handle.

3. A hand tool according to claim 2, wherein the handle is further moulded over the working head using injection moulding.

4. A hand tool according to claim 2, wherein the moulding material is a polymer.

5. A hand tool according to claim 1, wherein the handle is made of a moulding material and the handle is moulded over the handle protector using injection moulding.

6. A hand tool according to claim 1, wherein the front member and the side members form a substantially U-shape.

7. A hand tool according to claim 1, wherein the handle protector is further attached to the handle by an adhesive joint.

8. A hand tool according to claim 1, wherein the hand tool is an axe or a hammer.

9. The hand tool of claim 1, wherein the two side members extend substantially parallel to one another from respective edges of the front member.

10. The hand tool of claim 1, wherein the at least one protrusion of each side member extends substantially parallel from an edge of the side member.

11. A hand tool comprising:

a working head;

a handle connected to the working head, the handle configured for gripping by a user during operation of the tool, the handle comprising a raised portion surrounding a recessed area; and a handle protector attached to the handle at or proximate the raised portion of the handle, the raised portion being proximate the working head, wherein the handle protector is manufactured from a metal sheet, wherein the recessed area of the handle has a shape substantially corresponding to a shape of the handle protector, wherein the handle protector includes at least one protrusion that extends into the handle to facilitate attachment of the handle protector to the handle, wherein the handle protector includes a front surface and a rear surface, the rear surface of the handle protector being attached to the recessed area of the handle, wherein a portion of the handle is disposed between the working head and the handle protector, wherein the handle protector includes at least one indention on the front surface thereof and at least one corresponding raised portion of the rear surface thereof, wherein the at least one indention extends transversely along the handle protector relative to a longitudinal axis of the handle protector, and wherein the handle comprises a corresponding groove to receive the corresponding raised portion of the handle protector.

12. The hand tool of claim 11, wherein a moulding material is injected between the handle protector and the handle to attach the handle protector to the handle.

13. The hand tool of claim 12, wherein the handle is further moulded over the working head using injection moulding.

14. The hand tool of claim 12, wherein the moulding material is a polymer.

15. The hand tool of claim 11, wherein the handle is made of a moulding material and the handle is moulded over the handle protector using injection moulding.

16. The hand tool of claim 11, wherein the handle protector comprises a front member and two side members, wherein the front member and the side members form a substantially U-shape.

17. The hand tool of claim 16, wherein each of the side members at least partially extends into the handle.

18. The hand tool of claim 15, wherein each of the side members comprises the at least one protrusion extending into the handle.

* * * * *